United States Patent [19]

Lierke et al.

[11] Patent Number: 4,981,425

[45] Date of Patent: Jan. 1, 1991

[54] DEVICE FOR ULTRASONIC ATOMIZATION OF A LIQUID MEDIUM

[75] Inventors: Ernst-Gunter Lierke, Schwalbach; Klaus Luhmann, Russelsheim; Sigurd Jonsson, Alzenau; Michael Hohmann, Hanau; Lothar Bendig, Pfullingen; Frieder Hofmann; Reinhard Gaa, both of Metzingen, all of Fed. Rep. of Germany

[73] Assignee: Battelle-Institut E.V., Frankfurt am Main, Fed. Rep. of Germany

[21] Appl. No.: 247,106

[22] Filed: Sep. 15, 1988

[30] Foreign Application Priority Data

Sep. 25, 1987 [DE] Fed. Rep. of Germany ..... 3732325

[51] Int. Cl.[5] ..... B05B 17/06; B22F 9/06

[52] U.S. Cl. ..... 425/6; 264/9; 264/23; 425/135; 425/174.2

[58] Field of Search ..... 425/174, 174.2, 174.6, 425/6, 222, 174.8, 7, 135; 264/22, 23, 5, 9, 10; 75/0.05 B, 0.05 BA, 0.05 BC, 251, 10.1, 10.13

[56] References Cited

U.S. PATENT DOCUMENTS

| | | | |
|---|---|---|---|
| 3,397,258 | 8/1968 | Williams | 264/9 |
| 4,264,641 | 4/1981 | Mahoney et al. | 427/30 |
| 4,455,268 | 6/1984 | Hinrich et al. | 264/23 |
| 4,553,917 | 11/1985 | Lee | 425/6 |
| 4,671,906 | 6/1987 | Yasue et al. | 264/9 |

FOREIGN PATENT DOCUMENTS

| | | | |
|---|---|---|---|
| 0042903 | 1/1982 | European Pat. Off. . | |
| 0173435 | 3/1986 | European Pat. Off. . | |
| 0217518 | 4/1987 | European Pat. Off. . | |
| 1099239 | 2/1961 | Fed. Rep. of Germany . | |
| 2352678 | 4/1975 | Fed. Rep. of Germany | 425/174.2 |
| 2656330 | 3/1984 | Fed. Rep. of Germany . | |
| 2842232 | 4/1985 | Fed. Rep. of Germany . | |
| 61-78626 | 4/1986 | Japan | 425/174.2 |
| 63-93809 | 4/1988 | Japan | 75/0.05 B |
| 2098498A | 11/1982 | United Kingdom . | |

*Primary Examiner*—Jay H. Woo
*Assistant Examiner*—Khanh P. Nguyen
*Attorney, Agent, or Firm*—Fisher, Christen & Sabol

[57] ABSTRACT

Device which serves to atomize a solid or liquid medium with the aid of a standing ultrasonic wave that is generated between two ultrasonic transmitters. This allows one to tune the standing ultrasonic wave automatically when the temperature of the medium or other process parameters should change.

19 Claims, 1 Drawing Sheet

9
10
4
3
11
12
16
5
8
6
2
7
14
1
13

DEVICE FOR ULTRASONIC ATOMIZATION OF A LIQUID MEDIUM

BACKGROUND OF THE INVENTION

1. Field of the Invention

The invention relates to a device for atomizing melts, normal fluids or agglomerates with the aid of ultrasound, which device comprises a first ultrasonic transmitter and an ultrasonic reflector arranged at a distance from it, a standing ultrasonic wave being generated between the two elements into which the medium to be atomized is fed.

2. Background Art

This kind of device, which has proved useful in principle, has been described in the German Patent No. 2,656,330. The reflector is a passive component in this case, and the distance between transmitter and reflector is adjusted via an appropriate mechanical system which only shifts the reflector however. This printed patent specification already mentions that increasing the static gas pressure in the chamber surrounding the ultrasonic wave results in a proportional increase in the sound pressure level. Furthermore, it is mentioned that a gas jet may be injected into the chamber in order to sputter the atomized medium against a cold metal surface, thus causing it to cool down more rapidly.

A similar state of the art is specified in the German Patent No. 2,842,232, from which the idea can be adopted to inject the medium to be atomized into the pressure nodes of the standing ultrasonic wave. Because of the small distances at which the transmitter and the reflector are arranged at the described state of the art, however, liquid matter is deposited on the reflector during atomization, and the reflector is therefore smudged after a certain time. The transmitter on the other hand remains clean because the transmitter plate vibrates and because of the associated ultrasonic wind.

Further drawbacks of the known device result from sound field variations that are mainly induced by temperature variations occurring when the melt jet is injected into the sound field. This causes the parameters of the sound field to change, so that the reflector must be continuously adjusted to maintain the standing wave. As has been mentioned, this adjustment is asymmetrical to the aperture in the housing through which the melt or the medium to be atomized is supplied.

BROAD DESCRIPTION OF THE INVENTION

Taking a device with the above-described characteristics as the takeoff point, the objective of the invention therefore is to design the device in such a way that the detuning of the standing wave is automatically prevented during operation. In addition, the energy of the standing wave is to be substantially increased.

To achieve this objective, the invention involves a device wherein the reflector is designed as a second ultrasonic transmitter the electric and acoustic properties of which are roughly identical with those of the first transmitter. Using two equally powerful active ultrasonic transducers or transmitters, which act at the same time as transmitters and reflectors, not only increases the sound level, but also entails thermal and acoustic symmetry in the standing wave area so that one can automatically tune the sound wave when the temperature or any other operating parameter changes.

The medium to be atomized is injected in the center between the two transmitters, into a pressure node of the standing sound wave. The two transmitters are then shifted symmetrically to the feed aperture, equal distances inward or outward in axial direction.

Designing the reflector as an active ultrasonic transducer, i.e., as transmitter, prevents the atomized medium from settling on it, both transmitters being self-cleaning because of the ultrasonic wind produced.

The changes in the spacing of the two transmitters that are necessary to adjust to the resonance of the standing wave can be effected by a phase-sensitive or an amplitude-sensitive sound receiver preferably located near the front of one of the two transmitters and also preferably outside of the atomization area. But one can also control the changes in transmitter spacing automatically or manually on the basis of the ultrasonic power maximum, because both transducers have clear impedance maxima at the standing-wave resonance.

The two transmitters can be fed by individual frequency generators or by a single frequency generator. Using only one generator ensures that both transmitters vibrate at identical frequencies, without additional measures being necessary. When using a separate frequency generator for each transmitter one can let the frequencies differ slightly so that beats that must be expected to result from interference of the waves going out from the two transmitters have a frequency which does not harm atomization. For the same purpose the frequency generator can also be designed as a wobbler operating in a narrow frequency band around the natural frequencies of the two transmitters.

A small heated tube fixed to the casing is provided for feeding the medium to be atomized, which tube is suited for transporting especially a liquid melt from an appropriate reservoir. The outlet of the tube should be located a few millimeters above the axis connecting the two transmitters so that the melt can be atomized under optimum oscillating conditions. The radial distance can be 2 or 3 mm, for example. The outer diameter of the tube should not exceed about 6 to 8 mm at the outlet end, but at about 20 mm from the atomizing axis it can be increased to between 20 and 30 mm so that a resistance heating coil can be accommodated in the tube. This ensures that the melt is directly fed into the standing wave at an adequate temperature. The tube can be made of boron nitride to prevent adhesion of melt droplets.

An important embodiment of the invention is wherein the device is installed in a pressure vessel, so that atomization can take place at an overpressure of, say, between 3 and 10 bar, or possibly more. Because of the great surface tension of molten metal, sound levels above 180 dB are necessary for atomizing such melts. These high sound levels can only be achieved at gas overpressure. An inert gas is usually used for this purpose.

Atomizing molten metal at gas overpressure has the additional advantages that high sound levels are achieved with relatively small ultrasonic amplitudes of the transducers, which considerably prolongs the service life of the transducers and increases their efficiency.

Convection cooling of the atomized melt is improved at elevated pressure, so that the solidification time is shortened which means that amorphous solidification of the metal powders can occur.

Given the extremely fast solidification and relatively low flight velocity of the droplets (ca. 1 m/s), trajection in the molten state is short, so that the dimensions of the pressure vessel are relatively small. Laboratory units less than 1 m in diameter and 1 to 3 m high are feasible.

To prevent atomized particles from clinging to the transmitters or to the wall of the pressure vessel, before solidification, an air curtain preferably should be so arranged as to prevent the particles from reaching these surfaces.

Furthermore, the oxygen partial pressure should preferably be extremely low, because spherical particles are produced in the absence of oxygen, while irregular particles result at the normal oxygen partial pressure of air. These spattered particles, however, are possibly advantageous for sintering.

Increasing the sound level by increasing the amplitude and/or the gas pressure leads to altogether finer powders without having to change the frequency as is usually necessary in ultrasonic capillary wave atomization.

The device according to the invention is basically suited for ultrasonic atomization of all meltable or liquid media. In particular, it is suited for atomizing molten metal. Additional uses are described in the previously mentioned German Patents Nos. 2,656,330 and 2,842,232.

BRIEF DESCRIPTION OF THE DRAWING

The invention is exemplified by the following embodiment, which shows further important characteristics. The figure shows a partially schematic axial section through an atomizing device according to the invention, suited for atomizing of molten metal.

DETAILED DESCRIPTION OF THE INVENTION

Figures 1, 1A:
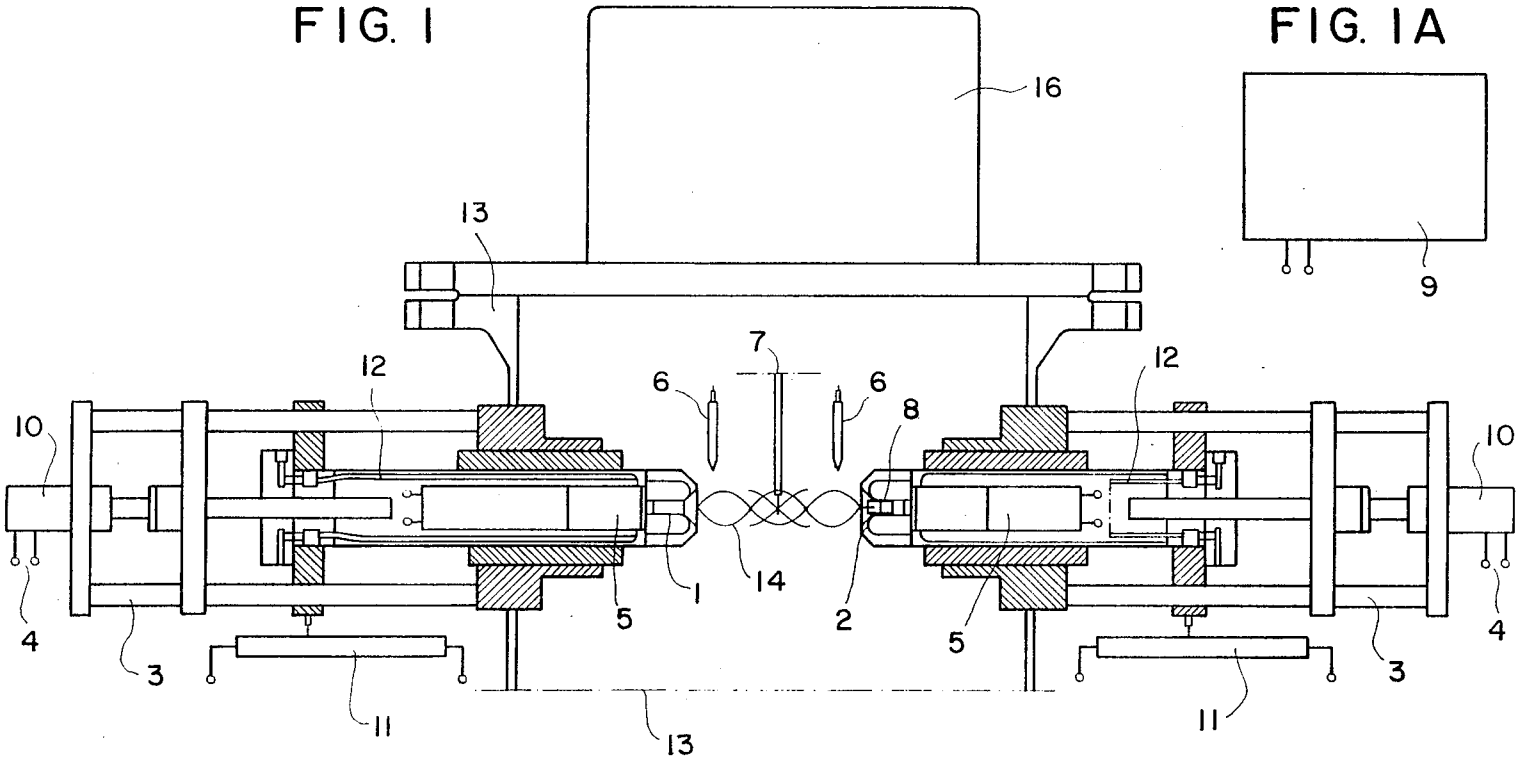

A first ultrasonic transmitter 1 and a second ultrasonic transmitter 2 are each mounted on a sledge unit 3 which is moved by a stepping motor or d.c. motor 4. Both transmitters 1,2 are preferably operated at the same frequency, which can be 20 kHz, for example. Both transmitters 1,2 can be fed by an own frequency generator 5 operating according to the principle of a feedback oscillator. Both transmitters 1,2 are equipped with an air curtain 6, as an additional measure against adhesion of the molten material. The mobile sledge units 3 adjust the distance between the transmitters 1,2 to the relevant operating conditions, symmetrical to a melt jet 7 which transports molten mass from a melting furnace 16 into the standing ultrasonic field 14 via a heated tube (not shown). Close to one of the two transmitters 1,2, a pressure sensor 8 is provided which measures the sound pressure of the standing wave 14 and passes the maximum value onto the electronic guidance system 9, from where the motor operators 4 receive their pulses. The sledge units are positioned by means of angular coders 10 at the motor operator, or by means of linear potentiometers 11 connected to the sledge. The electronic guidance system 9 always seeks that position where the pressure of the sound field 14 is at its maximum. The frequency of the second transmitter 2 can be close to that of the first transmitter 1. The two frequencies should differ by at least 0.5 percent to avoid unacceptable low-frequency beats resulting from interference of the waves from the two transmitters.

In a modified embodiment of the invention the two transmitters 1,2 are operated with one frequency generator at exactly identical frequency and identical phase relationship.

The generator can also be designed as a wobbler operating in a narrow frequency band around the natural frequencies of the two transmitters.

The two transmitters can be cooled by air blast 12, or with water or oil.

The described device is installed in a pressure vessel 13 so that the interior space with the standing sound field in it is pressure sealed toward the outside. This means that the pressure inside of the chamber can be increased accordingly, which in turn results in a higher energy density of the standing ultrasonic wave 14 at unchanged amplitude of the ultrasonic transmitters. The results are improved efficiency of atomization and at the same time an increase in the useful life of the transmitters if the amplitudes of the ultrasonic transmitters are reduced.

The air curtains 6 can be provided in front of the transmitters (1,2) and/or before the inside wall of the pressure vessel (13).

A measuring instrument can be provided which measures the power consumption of at least one of the transmitters.

The chamber can be filled with air, an inert gas or any other gas or gas mixture, and the partial oxygen pressure can be adjusted accordingly.

What is claimed is:

1. Device for atomizing a liquid media with the aid of ultrasound, comprising a first ultraasonic transmitter (1) and a second ultrasonic transmitter (2) provided at a distance to each other on an axis, between which a standing ultrasonic wave (14) is generated into which the liquid media to be atomized is fed, the electric and acoustic properties of the second ultrasonic transmitter (2) being about identical with those of the first ultrasonic transmitter (1), the frequencies of the two transmitters (1,2) differ slightly, an appliance (3,4) being provided which shifts the two transmitters (1,2) in axial direction symmetrically to the stream of the liquid media, and said device being installed in a pressure vessel (13) so that the ultrasonic transmitters (1,2) are located within the pressure vessel (13).

2. Device according to claim 1 wherein the liquid media is a melt.

3. Device according to claim 2 wherein the feeding of the medium to be atomized takes place through an aperture in the pressure vessel and in the center between the two transmitters (1,2) into a pressure node of the sound wave (14) caused by a standing-wave resonance of the impedance maxima of the two transmitters (1,2).

4. Device according to claim 3 wherein a pressure sensor (8) is provided which measures the intensity of the sound pressure of the standing wave (14) and means to convert such measurements into electronic signals.

5. Device according to claim 4 wherein there is means which measures the maximum value of the electronic output signals of the pressure sensor (8), the maximum value of the intensity of the sound pressure is electronically passed to an electronic guidance system (9), and the electronic guidance system (9) electronically directs the motor operators (4) of said appliance (3,4), which control the distance between the transmitters (1,2) by axially moving the transmitters (1,2) relative to each other, to maximize the pressure of the sound wave (14).

6. Device according to claim 4 wherein a measuring instrument is provided which measures the power consumption of at least one of the transmitters (1,2).

7. Device according to claim 6 wherein there is a means which measures the maximum value of the electronic output signals of a pressure sensor (8), the maximum value of the intensity of the sound pressure is electronically passed to an electronic guidance system (9), the electronic guidance system (9) electronically directs the motor operators (4) of said appliance (3,4) which control the distance between the transmitters (1,2) by axially moving the transmitters (1,2) relative to each other, to maximize the pressure of the sound wave (14).

8. Device according to claim 7 wherein the two transmitters (1,2) are each supplied from their own frequency generators (5).

9. Device according to claim 7 wherein the frequency of the power generator (5) is wobbled around the resonance frequencies of the two transmitters (1,2).

10. Device according to any of claim 7 wherein a small heated tube having an outlet end fixed to the pressure vessel is provided for feeding the medium into the standing sound wave (14), the outlet end of said small tube being located a few millimeters above the axis of the transmitters.

11. Device according to claim 10 wherein an air curtain (6) is provided between each of the transmitters (1,2) and the stream of the melt so as to keep the atomized melt from settling on transmitters (1,2).

12. Device according to claim 11 wherein a facility is provided for controlling the oxygen partial pressure inside of the pressure vessel (13) around the standing sound wave (14).

13. Device according to claim 2 wherein a pressure sensor (8) is provided which measures the intensity of the sound pressure of the standing wave (14) caused by a standing-wave resonance of the impedance maxima of the two transmitters (1,2) and means to convert such measurements into electronic signals.

14. Device according to claim 2 wherein a measuring instrument is provided which measures the power consumption of at least one of the transmitters (1,2).

15. Device according to claim 2 wherein the two transmitters (1,2) are each supplied from their own frequency generators (5).

16. Device according to claim 2 wherein the frequency of the power generator (5) is wobbled around the resonance frequencies of the two transmitters (1,2).

17. Device according to claim 2 wherein a small heated tube having an outlet end fixed to the pressure vessel is provided for feeding the medium into the standing sound wave (14), the outlet end of said small tube being located a few millimeters above the axis of the transmitters.

18. Device according to claim 2 wherein an air curtain (6) is provided between the transmitters (1,2) and the stream of the melt so as to keep the atomized melt from settling on transmitters (1,2).

19. Device according to claim 2 wherein a facility is provided for controlling the oxygen partial pressure inside of a chamber (13) located around the standing sound wave (14).

* * * * *